United States Patent [19]

Czelusniak, Jr.

[11] 4,406,309

[45] Sep. 27, 1983

[54] METHOD AND APPARATUS FOR FORMING A WOVEN PILE FABRIC

[75] Inventor: Paul A. Czelusniak, Jr., Eden, N.C.

[73] Assignee: Fieldcrest Mills, Inc., Eden, N.C.

[21] Appl. No.: 308,402

[22] Filed: Oct. 5, 1981

Related U.S. Application Data

[63] Continuation-in-part of Ser. No. 272,505, Jun. 11, 1981.

[51] Int. Cl.[3] ..... D03D 27/06; D03D 39/20

[52] U.S. Cl. ..... 139/402; 139/46; 112/79 R

[58] Field of Search ..... 139/46, 47, 37, 38, 139/402, 403; 112/79 R; 66/207, 204

[56] References Cited

U.S. PATENT DOCUMENTS

| | | | |
|---|---|---|---|
| Re. 24,949 | 3/1961 | Clark | 139/46 |
| 2,655,951 | 10/1953 | Clark | 139/46 X |
| 2,860,665 | 11/1958 | MacIsaac, Jr. et al. | 139/46 |
| 3,091,263 | 5/1963 | Troy | 139/402 |
| 3,625,260 | 12/1971 | Troy | 139/402 |
| 3,636,988 | 1/1972 | Troy et al. | 139/46 |

*Primary Examiner*—James Kee Chi

*Attorney, Agent, or Firm*—Bell, Seltzer, Park & Gibson

[57] ABSTRACT

A method and apparatus for weaving pile fabrics of the type whose pile tufts are formed by shogging pile yarns weftwise over warpwise extending pile wires. Two sets of pile yarns are employed extending through respective sets of pile yarn guides arranged in weftwise rows on a loom, and the pile yarn guides, with the pile yarns extending therethrough are pattern controlled in such a manner that, in the forming of warpwise extending rows of pile tufts on the fabric, pile tufts are, at times, formed in each row from one set of pile yarns and at other times pile tufts are formed in each row from the other set of pile yarns, and the pile yarn set which is not forming pile tufts is forming floats between the warpwise extending rows of pile tufts.

13 Claims, 9 Drawing Figures

METHOD AND APPARATUS FOR FORMING A WOVEN PILE FABRIC

This application is a continuation-in-part of co-pending application Ser. No. 272,505, filed June 11, 1981, and entitled WOVEN PILE FABRIC.

This invention relates to the manufacture of woven pile fabrics and, more especially, to an improved method and apparatus for making pile fabrics with a variety of pattern effects utilizing the principle of shogging pile yarns weftwise over and across warpwise extending pile wires for forming warpwise rows of pile loops.

More particularly, this invention relates to the manufacture of woven pile fabrics wherein two sets of pile yarns are provided which form warpwise extending rows of pile tufts, with each of the sets of pile yarns appearing in each of the rows. While pripr art fabrics of this type are well known, the fabrics formed in accordance with the method and apparatus of this invention differ thereover in that, instead of both sets of pile yarns simultaneously forming pile tufts, only one set of pile yarns is formed into pile tufts while the other set of pile yarns is formed into pile yarn floats extending across the base fabric between the warpwise rows of pile tufts. Pattern controlled means are provided for controlling which set of pile yarns is forming tufts and which set is forming the floats extending between the rows of pile tufts.

The method and apparatus of this invention permit, for example, obtaining unusual and unique color or pattern effects by permitting selective bringing to the surface of the fabric the color or colors present in that particular set of pile yarns that is desired, while floating and hiding from view the pile yarns of the other set. This floating of the one set of yarns results in a saving of pile yarn as compared to prior art techniques of forming ground engaging loops, that is, short height loops, of the yarn of the set desired to be hidden from view below the surface of the pile fabric.

In obtaining fabrics of the type that this invention is concerned with, a method and apparatus are provided for selectively shogging one of a pair of sets of yarns over pile wires while floating the other set of pile yarns across the base fabric between the pile wires. In practice, the shogging over the pile wires is somewhat of a greater stroke of shogging movement than the shogging over the base fabric between the pile wires, but the combined distance of both shoggings is equal to the gauge of the machine, i.e., the center-to-center distance between adjacent pile wires.

BRIEF DESCRIPTION OF THE DRAWINGS

Some of the features and advantages of the invention having been stated, others will appear as the description proceeds when taken in connection with the accompanying drawings in which.

DETAILED DESCRIPTION

While this invention will be described hereinafter with particular reference to the accompanying drawings, in which an illustrative embodiment of the present invention is set forth, it is to be understood at the outset of the description which follows that it is contemplated that persons skilled in the applicable art may modify the specific details to be described while continuing to use this invention. Accordingly, the description is to be understood as a broad teaching of this invention, directed to persons skilled in the applicable arts.

Figure 1:
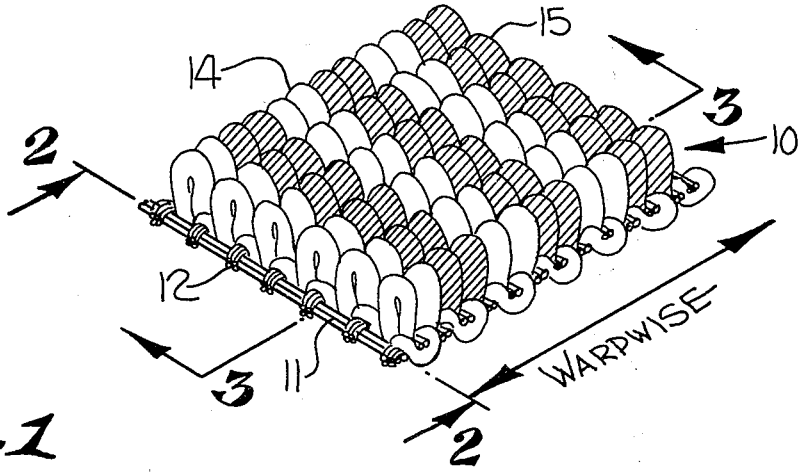
FIG. 1 is a perspective view of a woven loop pile fabric constructed utilizing the method and apparatus of the present invention.
Figure 2:
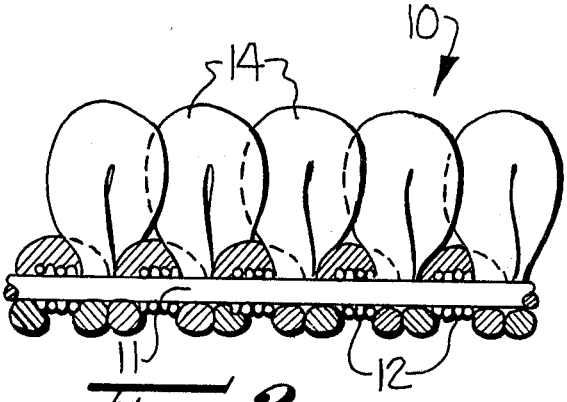
FIG. 2 is an enlarged fragmentary weftwise or transverse vertical sectional view taken substantially along line 2—2 in FIG. 1.
Figure 3:
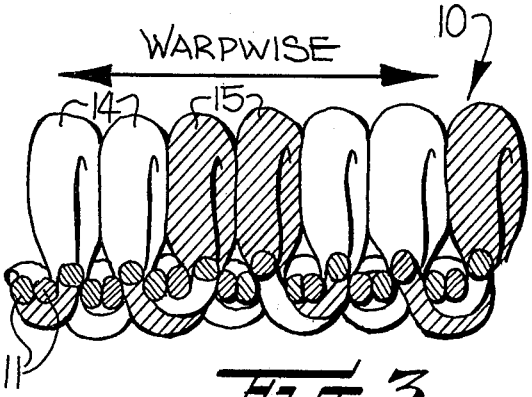
FIG. 3 is an enlarged fragmentary warpwise of longitudinal vertical sectional view taken substantially along line 3—3 in FIG. 1.

An embodiment of a woven pile fabric made in accordance with the method of the present invention is broadly designated at 10 in FIGS. 1-3, and a loom embodying apparatus for carrying out the method is shown in FIGS. 5-9. The fabric 10 is of a type fully described and claimed in said co-pending application, Ser. No. 272,505, and includes a base fabric woven from ground weft yarns or weft shots 11 and groups of ground warp yarns 12, there preferably being about four ground warp yarns 12 in each group. At least two sets of pile yarns 14, 15 are interwoven with the base fabric to form warpwise and weftwise extending rows of pile tufts shown in the form of pile loops. Some or all of the pile tufts may be in the form of cut pile, if desired. In any event, it is preferred that the pile yarns of each set are of different dye affinity or of different visual characteristics from the pile yarns of the other set, such as color, shade, texture, twist, type, size, or the like, in order that the desired pattern effects may be obtained.

As best shown in FIG. 1, in accordance with the method of this invention, the pile tufts in each warpwise row R1 are formed from pile yarns of both sets 14, 15 arranged in a predetermined alternate sequence. In any given weftwise row of pile tufts, however, it is to be noted that the pile yarns of only one of the sets is in the form of pile tufts, and the pile yarns of the respective other set of pile yarns are inactive and hidden from view by the pile tufts of those pile yarns of the said one set of pile yarns. Accordingly, two pile yarns (one pile yarn from each set of pile yarns) cooperate with each group of ground warp yarns 12 and are selectively brought to the face of the fabric as tufts, with the inactive pile yarn being floated and undulatingly arranged over and across the respective group of warp yarns 12 and under the weft yarns 11, as best illustrated in FIGS.

2 and 4. The warpwise rows of floats are indicated at R2 in FIG. 4.

The apparatus or loom for carrying out the method of the present invention may be of the general type disclosed in Troy et al U.S. Pat. No. 3,636,988 suitably modified to effect the desired pile pattern. Therefore, only so much of the loom will be described as is necessary to a clear understanding of the present invention, and reference is made to said U.S. Pat. No. 3,636,988 for a more detailed disclosure of a loom of this type.

Figure 4:
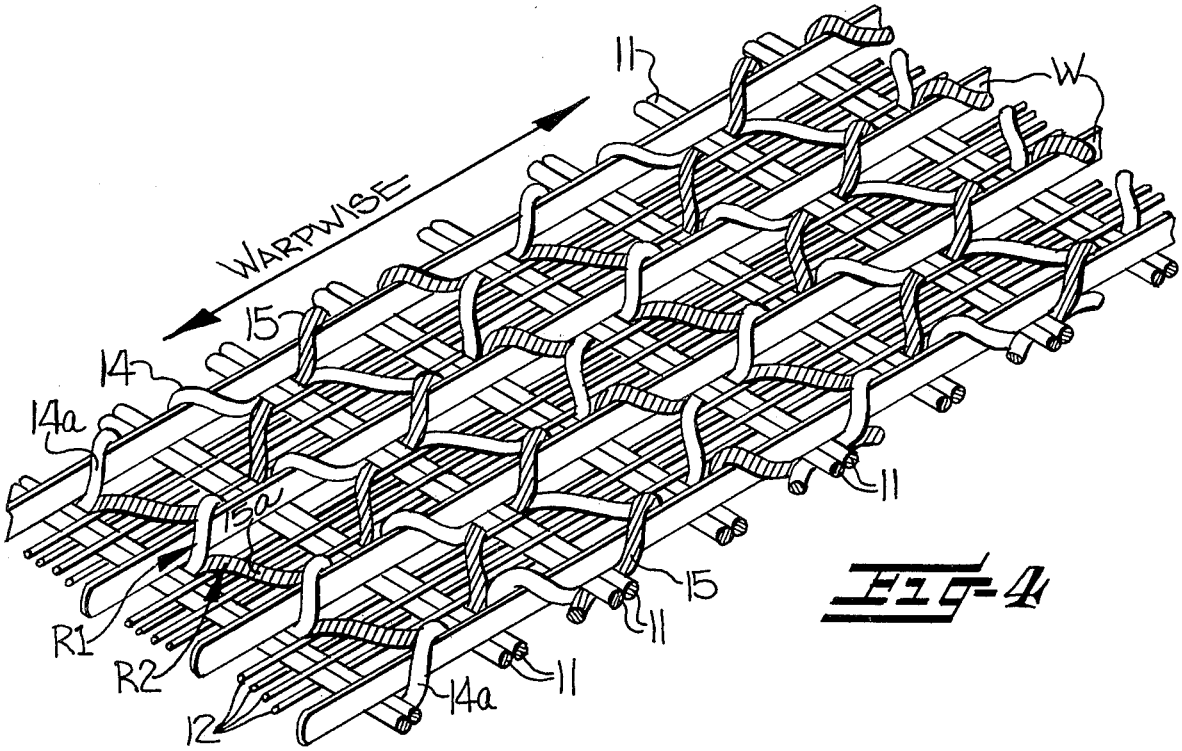
FIG. 4 is a schematic perspective view showing an arrangement of warpwise pile wires in exaggerated spaced relationship overlying a portion of the pile fabric of FIGS. 1-3 for illustrating how the pile loops or tufts and the pile yarn floats may be formed during weaving.

Essentially, the loom comprises the usual weaving instrumentalities, namely, beating-up means embodied in an oscillatable reed 20 (FIG. 6), shed-forming means embodied in relatively movable harnesses 21, and weft-inserting means which may take the form of a weft inserter or needle 22 for inserting a double weft yarn in the warp shed during each reciprocation of the weft inserter, as indicated in FIGS. 3 and 4. Although each of the weft yarns 11 is shown in the form of two parallel strands, it is apparent that the pile fabric 10 is of a one-shot weave construction, since there are no weft strands below the upper bites of any of the pile loops, i.e., a weftwise row of loops is formed during each pick of the loom. Therefore, each double weft yarn may be termed collectively as a single weft shot. Each weft shot may be in the form of a single strand, if desired.

Figure 5:
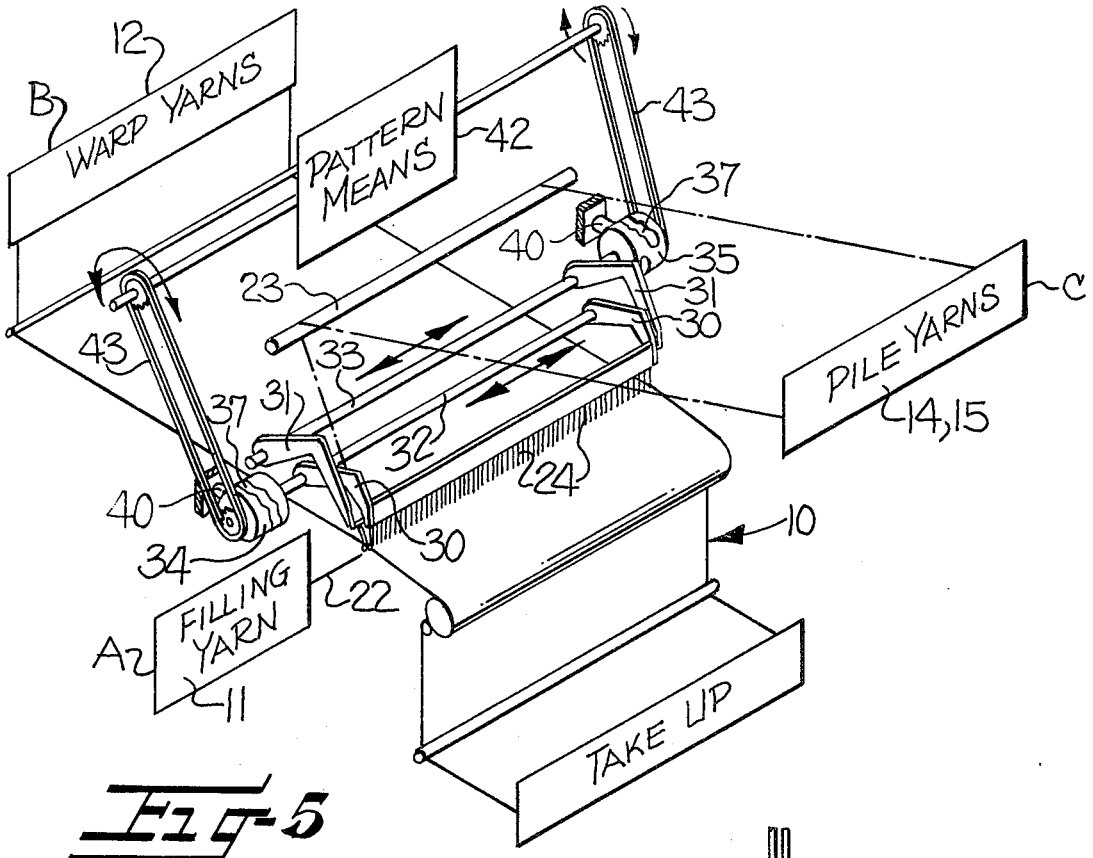
FIG. 5 is a perspective view of a loom schematically illustrating a preferred embodiment of pattern controlled mechanism for selectively shogging weftwise two sets of pile yarns according to the present invention.
Figure 6:
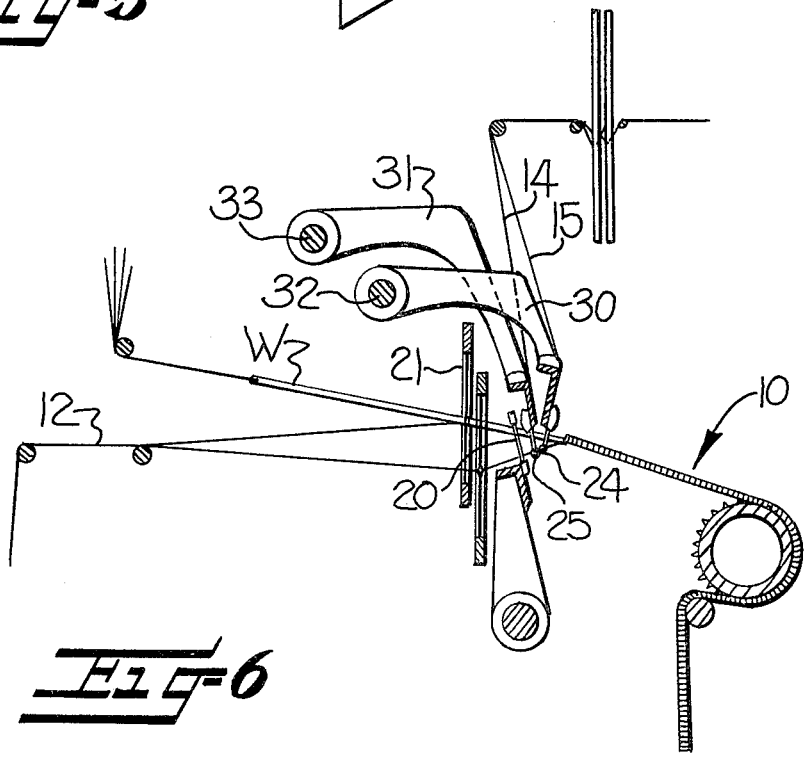
FIG. 6 is a schematic longitudinal vertical sectional view through the loom.

Referring now to the loom shown in FIGS. 5 and 6, it will be observed that the ground weft and warp yarns 11, 12 are directed from respective sources A, B to the weaving instrumentalities for weaving the base fabric, and the two sets of pile yarns 14, 15 are directed from a source C over or through suitable guide means 23 and then downwardly through respective sets of pile yarn guides or dip needles 24, 25 extending in respective weftwise rows, and which may be constructed and mounted in substantially the same manner as the pile yarn guides 95, 96 of the aforementioned U.S. Pat. No. 3,636,988. The sets of pile yarns 14, 15 extend from their respective pile yarn guides 24, 25 to the fell of the fabric 10 being woven.

The sets of pile yarn guides 24, 25 are carried by respective sets or pairs of crank arms 30, 31 which extend upwardly and rearwardly from the respective sets of pile yarn guides 24, 25 and have rear portions thereof fixedly mounted on respective rocker shafts 32, 33. These rocker shafts extend substantially throughout the width of the loom and are mounted for both axial motion and angular motion about their axes in the usual side frame members, not shown, of the loom.

Conventionally, the pile yarn guides 24, 25 are dipped downwardly from a raised or withdrawn position above the level of the pile wires W and into the warp shed below the path of the weft inserter 22 prior to each weft-inserting operation during the weaving of a one-shot weave construction. Following withdrawal of the weft inserter 22, the pile yarn guides 24, 25 then are returned to the withdrawn position to loop the tensioned pile yarns beneath and partially around corresponding weft yarns as reed 20 beats the last-inserted weft yarn against the fell of the fabric 10. The means for dipping the pile yarn guides 24, 25 in this manner is well known to those versed in the weaving arts (see U.S. Pat. No. Re. 24,949, for example), and thus a further more detailed discussion of the dipping means is deemed unnecessary.

The aforementioned U.S. Pat. No. 3,636,988 discloses pattern controlled means for selectively shogging two weftwise rows of pile yarn guides and respective sets of pile yarns in the same or opposite weftwise directions independently of each other over and across one or more pile wires and/or groups of ground warp yarns. However, the extent of the weftwise shogging of the pile yarn guides heretofore has been essentially the same as the center-to-center distance between adjacent pile wires, and the same as the center-to-center distance between adjacent pile yarn guides. Since the distance weftwise between the centers of adjacent warpwise rows of pile loops is generally known as the "gauge" of the pile fabric, the aforementioned center-to-center distance weftwise between adjacent pile wires W and between adjacent pile yarn guides in each set thereof also is one gauge. In this regard, the term "pitch" is also used herein in its usual textile sense to identify "the number of warpwise rows of pile tufts or pile loops per inch" weftwise of the pile fabric.

In order to form the pile tufts and floats in the arrangement described in accordance with this invention, the two adjacent pile yarns 14, 15 forming any given warpwise row of pile tufts are retained in the fabric in substantially the weftwise space or gauge space usually occupied by only one pile yarn, although each pile yarn may be multi-ply or single-ply yarn, as desired. This is accomplished by controlling the operation of the sets of pile yarn guides 24, 25 so as to reduce the length of the weftwise shogging strokes heretofore usually imparted to the pile yarn guides 24, 25 in forming each warpwise row of pile tufts so that, while one set of pile yarn guides is being shogged weftwise over and across the pile wires W, the other set of pile yarn guides is being shogged weftwise over and across only the groups of ground warp yarns 12 between the pile wires W.

It follows, therefore, that each time the sets of pile yarn guides 24, 25 are shogged weftwise, each set is shogged a distance substantially less than one gauge, even though the center-to-center distance between the pile yarn guides in each set and between adjacent pile wires W is one gauge. Generally, the distance each pile yarn guide of each set is shogged over and across the pile wires W is about one-half or slightly greater than one-half of a gauge, and the distance that each pile yarn guide of each set is shogged over and across portions of the base fabric located between the pile wires W is about one-half or slightly less than one-half of one gauge. In any event, the weftwise distance each pile yarn guide is shogged across a respective pile wire W, combined with the weftwise distance each pile yarn guide is shogged across a respective portion of the fabric between the pile wires W, is about the same as the center-to-center distance between any two adjacent pile wires W, i.e., one gauge. By observing the zigzag paths traced by the sets of pile yarns 14, 15 in FIG. 4, it can be appreciated that, even though the pile yarn guides in the first set 24 dip into the warp shed (see FIGS. 5 and 6) between adjacent groups of ground warp yarns 12 at the same time that respective pile yarn guides in the second set 25 dip into the warp shed between the same adjacent groups of ground warp yarns 12, the individual pile yarn guides 24, 25 which have dipped into the same space between any two adjacent groups of ground warp yarns 12 will be moved in opposite weftwise directions away from each other during the next shogging operation of the sets of pile yarn guides 24, 25 and the respective sets of pile yarns 14, 15.

Figure 7:
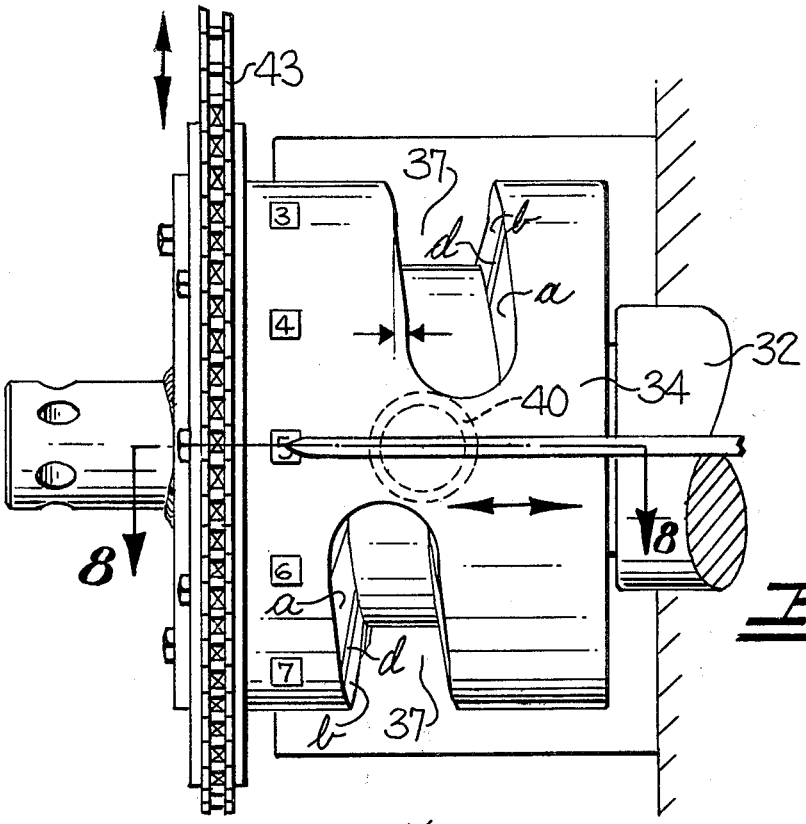
FIG. 7 is a fragmentary elevation of that cam means shown in the left-hand portion of FIG. 5 for shogging one of the sets of pile yarn guides and the respective set of pile yarns weftwise of the loom.
Figure 8:
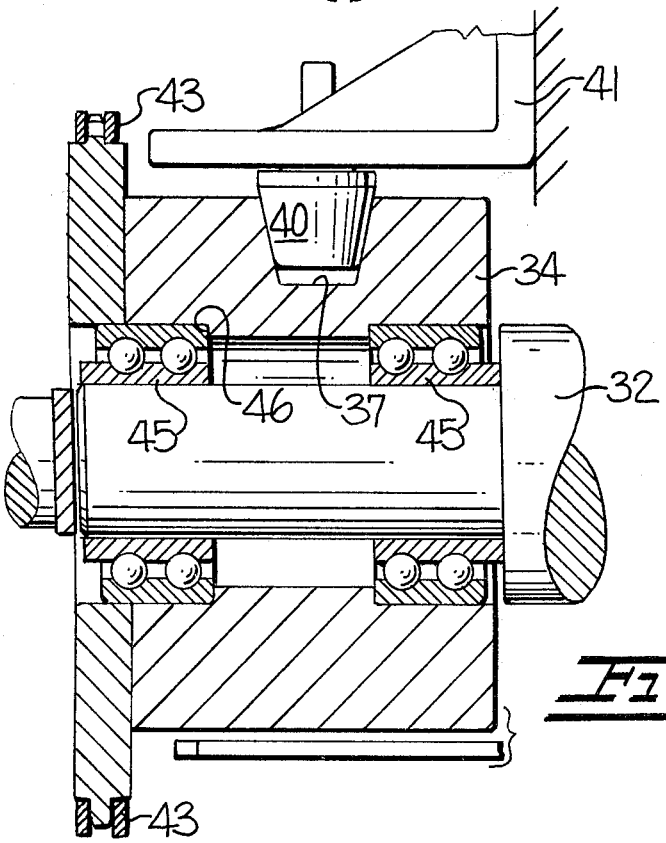
FIG. 8 is a fragmentary sectional plan view taken substantially along line 8—8 in FIG. 7.

Accordingly, pattern controlled means is provided for shogging weftwise the sets of pile yarn guides 24, 25 and the respective sets of pile yarns 14, 15 in the desired manner. Such pattern controlled means is embodied in a pair of cylindrical or drum-like shogging cams 34, 35 (FIGS. 5, 7 and 8) mounted on or otherwise connected to the distal end portions of the respective rocker shafts 32, 33. Each shogging cam 34, 35 has an irregular peripheral cam groove 37 therein extending helically about the cam and being engaged by a respective follower 40 (FIGS. 7 and 8). Each follower 40 is suitably supported in a stationary position on suitable mounting means 41 carried by the loom frame so that the follower imparts an axial shogging movement to the respective shogging cam 34, 35 whenever the respective shogging cam is rotated relative to the follower. The shogging cams 34, 35 are rotated or oscillated in a stepwise manner by a suitable pattern means 42 operatively connected as by sprocket and chain connections 43, to the respective shogging cams.

As indicated earlier herein, the rocker shafts 32, 33 are rocked about their axes in order to effect the dipping of the pile yarn guides 24, 25 into and out of the warp shed during each pick of the loom in making a one-shot weave fabric, utilizing a dipping motion substantially of the type disclosed in said U.S. Pat. No. 3,636,988, for example. Therefore, it is necessary that the shogging cams 34, 35 are mounted so that they may be oscillated about their own axes relative to the rocker shafts 32, 33 while being movable axially in fixed relation to the respective rocker shafts 32, 33 for shogging the shafts 32, 33 and the respective sets of pile yarn guides 24, 25 weftwise relative to the pile wires W and the base fabric being woven.

Figure 9:
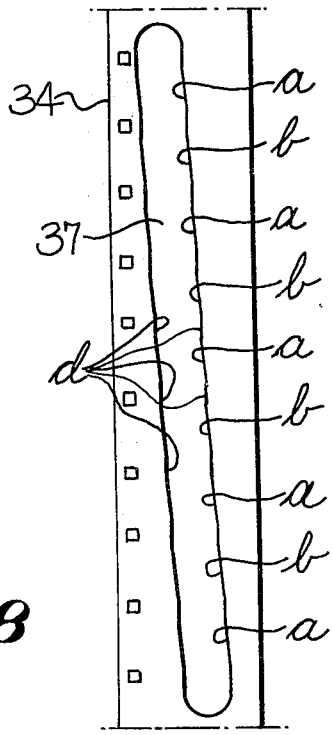
FIG. 9 is a developed view illustrating a preferred arrangement of the cam surfaces of the cam means illustrated in FIGS. 7 and 8.

Accordingly, each shogging cam 34, 35 may be mounted substantially as shown in FIG. 8, wherein it will be observed that bearings 45 rotatably mount the shogging cam 34 on shaft 32, and the outer races of the bearings 45 engage shoulders 46 on the cam 34 for transmitting force from the cam 34, when moved angularly about its axis, to the shaft 32 in the axial direction and to thereby shog the respective set of pile yarn guides 24 in the desired weftwise direction for the desired distance. As shown in FIG. 9, the helical cam groove 37 is provided with a series of closely spaced stepped camming surfaces with intervening dwell surfaces d therebetween. Alternate camming surfaces on one side of groove 37 are indicated at a and intervening camming surfaces are indicated at b.

The pattern mechanism 42 is so arranged that, whenever the pile yarn guides 24, 25 are positioned between adjacent pile wires W and are positioned in the warp shed, as shown in FIG. 6, each follower 40 (FIGS. 7 and 8) is in engagement with one of the dwell surfaces d and the shogging cams 34, 35 are at a standstill. Thus, no weftwise shogging movement is imparted to the sets of pile yarn guides 24, 25 during the dipping of the pile yarn guides into and out of the warp shed. However, the pattern mechanism 42 then imparts a step in rotation to each shogging cam 34, 35 in one direction or the other causing one of the two followers 40 to ride along one of the alternate camming surfaces a of one of the shogging cams 34, 35 and causing the other of the followers 40 to ride along one of the intervening camming surfaces b of the other of the shogging cams 34, 35.

In the weaving of an exemplary pile fabric in accordance with this invention, the loom was set up for weaving a five pitch pile fabric, i.e., a pile fabric having five warpwise rows R1 (FIG. 4) of pile per weftwise inch thereof. Therefore, it is apparent that one gauge of the pile fabric 10 was 0.200 inch. It was thus determined that the axial displacement between the two dwells d defining opposite ends of each alternate camming surface a should be about 0.110 inch, and the axial displacement between two adjacent dwells d defining opposite ends of each intervening camming surface b should be about 0.090 inch. Thus, with such arrangement of the camming surfaces a, b, each time one of the followers 40 rides against a camming surface a from one dwell d to the next adjacent dwell d, the pile yarn guides of the corresponding one set are shogged 0.110 inch weftwise over and across the pile wires W in the direction determined by that direction of rotation of the particular shogging cam 34 or 35 and by the direction of the lead of the helix defined by the respective cam groove 37. At the same time, the other of the followers 40 rides against a camming surface b from one dwell d to the next dwell d, causing the pile yarn guides of the other of said sets to be shogged 0.090 inch weftwise over and across the groups of ground warp yarns 12 in the direction determined by the direction of rotation of the other of the shogging cams and by the direction of the lead of the helix defined by the respective cam groove 37.

In any event, as indicated above, and as is preferred, the first or front set of pile yarn guides 24 is always shogged in that weftwise direction opposite from the direction in which the second or rearward set of pile yarn guides 25 is being shogged during any given pick of the loom, as indicated by comparing the different zigzag paths traced by the pile yarns of the respective sets 14, 15 in FIG. 4. In forming the fabric as illustrated in FIG. 4, it can be seen that the set of pile yarn guides 24 of FIGS. 5 and 6 and the pile yarn set 14 are shogged weftwise from right to left in FIG. 4 over and across the pile wires W and into the base fabric to form the pile loops 14*a* in the bottom portion of FIG. 4, and after which a weft shot 11 is inserted and beaten up against the fell of the base fabric. While the pile yarn set 14 was being shogged from right to left over and across the pile wires W, it can be appreciated that the shogging cam 35, connected to the rocker shaft 33 in the right-hand portion of FIG. 5, was being rotated one step so that the respective follower 40 rode against one of the camming surfaces b (FIG. 9) of cam 35 thus shogging the second set of pile yarn guides 25 and the respective second set of pile yarns 15 from left to right in FIG. 4 and over and across the respective groups of ground warp yarns 12, and into the base fabric to form the pile yarn floats 15*a* in the bottom portion of FIG. 4.

Following the insertion and beat-up of the corresponding weft shot 11, a reverse stepwise movement is imparted to the shogging cams 34, 35 by the pattern mechanism 42, thus moving the two sets of pile yarn guides 24, 25 and the respective sets of pile yarns 14, 15 for the same distance as, but in the respective opposite directions from, that in which the respective pile yarn guides 24, 25 and pile yarns 14, 15 has last previously moved.

This may be repeated, with the pile yarn guides of each set being shogged, first in one weftwise direction and then in the opposite weftwise direction, for as many times as desired for forming loops of the pile yarn set 14 over the respective pile wires W and for forming floats of the pile yarn set 15 extending over and across the respective groups of ground warp yarns 12 and between the adjacent pile wires W and the adjacent rows R1 of pile tufts. Thereafter, the pile yarn guides 24, 25 and the respective pile yarns 14, 15 are transposed as the shogging cam 34 on the rocker shaft 32 moves an additional step in the same direction as that in which it had last been moved so that the respective follower 40 rides against one of the camming surfaces b from one dwell d to the next. Similarly, the other cam 35 associated with the rocker shaft 33 is moved one step in the same direction in which it had last been moved by the pattern mechanism 42 so as to cause the respective follower 40 to ride against one of the surfaces a from one dwell d to the next, so that floats are then formed from the pile yarn set 14 while loops are being formed over the pile wires from the pile yarn set 15, as shown between the third and fourth picks or weft shots 11 in the lower portion of FIG. 4. The next succeeding weftwise row of alternating pile tufts or loops and pile yarn floats then will be formed by again shifting the shogging cams 34, 35 one step in the opposite direction from that in which they had last previously been moved in order to effect the desired shogging of the sets of pile yarns incidental to the formation of such pile loops and pile yarn floats.

From the foregoing description, it can be appreciated that the pattern mechanism 42 controls the shogging of the sets of pile yarn guides 24, 25, via the shogging cams 34, 35, to form pile from the two sets of pile yarns 14, 15 according to the method of this invention, and wherein at times, the first set of pile yarn guides may serve to repeatedly shog each pile yarn of the first set 14 back and forth over and across the same respective pile wire W, first on one weftwise direction and then in the opposite weftwise direction, and into the base fabric to form pile loops from the first set of pile yarns 14 extending upwardly from and interwoven with the base fabric. At the same time, the other or second set of pile yarn guides 25 may serve to shog each pile yarn of the other or second set 15 back and forth, but in the weftwise direction opposite from that in which the first set of pile yarns 14 is being shogged in each instance, and over and across the same respective group of ground warp yarns 12 between the pile wires W and into the base fabric between adjacent groups of ground warp yarns 12 to form pile yarn floats from the other or second set of pile yarns 15 extending between the pile loops and secured to the base fabric.

It can also be appreciated, by reference to FIG. 4, that the pattern mechanism 42 (FIG. 5) and the shogging cams 34, 35 may serve, at other times, to cause the second set of pile yarn guides 25 to repeatedly shog each pile yarn of the second set 15 back and forth, weftwise of the base fabric, over and across the same respective pile wire W and into the base fabric to form pile loops from the second set of pile yarns 15 extending upwardly from and interwoven with the base fabric, while causing the first set of pile yarn guides 24 to shog each pile yarn of the first set 14 back and forth, but in the weftwise direction opposite from that in which the second set of pile yarns 15 is being shogged in each instance, and over and across the same respective group of ground warp yarns 12 between the pile wires W and into the base fabric between adjacent groups of warp yarns 12 so as to form pile yarn floats from the first set of pile yarns 14 extending between the pile loops of the second set of pile yarns 15 and secured to the base fabric.

It is thus seen that the invention provides a method and apparatus for weaving pile fabrics wherein pattern controlled means embodied in the pattern mechanism 42 and shogging cams 34, 35, is provided for selectively and alternately shogging the two sets of pile yarn guides 24, 25 and the respective sets of pile yarns 14, 15 over and across warpwise extending pile wires and into the base fabric being woven so as to form pile loops from the respective pile yarns over and across the pile wires and wherein the pattern control means is operable, whenever the pile yarn guides in either one of the sets of pile yarn guides 24, 25 are being shogged over pile wires W, to alternately shog the pile yarn guides of the other of the sets over and across only those portions of the base fabric located between the pile wires W; i.e., over and across only the groups of ground warp yarns 12, so as to form pile yarn floats of the respective pile yarns over the portions of the base fabric which are defined by the groups of ground warp yarns 12 and which extend between the pile loops and between the pile wires.

In the drawings and specification there has been set forth a preferred embodiment of the invention, and although specific terms have been employed, they are used in a generic and descriptive sense only and not for purposes of limitation, the scope of the invention being defined in the claims.

That which is claimed is:

1. A method for forming a woven pile fabric having warpwise extending rows of pile tufts formed from two sets of pile yarns with the tufts formed of the two sets being arranged in a predetermined alternating sequence in each row warpwise of the fabric comprising forming a base fabric by interweaving ground warp and weft yarns while at times forming pile tufts in each row from one set of pile yarns and alternatively and at other times forming pile tufts in each row from the other set of pile yarns while floating weftwise over and across ground warp yarns extending between the warpwise extending rows of pile tufts that set of pile yarns that is not then forming pile tufts.

2. A method of making a woven tufted pile fabric from two sets of pile yarns with the tufts formed of the sets being arranged in a predetermined alternating sequence in each row warpwise of the fabric comprising forming a base fabric by interweaving ground warp and weft yarns while at times shogging weftwise one set of pile yarns over and across warpwise extending pile wires and into the base fabric to form pile extending upwardly from and interwoven with the base fabric while also shogging weftwise the other set of pile yarns over and across portions of the base fabric between the pile wires and into the base fabric to form floats extending weftwise over and across the ground warp yarns extending between the pile and secured to the base fabric, and at other times transposing the sets of pile yarns so as to alternatively form pile from the other set of pile yarns and alternatively form floats from said one set of pile yarns.

3. A method of making a woven tufted pile fabric from two sets of pile yarns with the tufts formed of the twos sets being arranged in a predetermined alternating sequence in each row warpwise of the fabric comprising forming a base fabric by interweaving ground warp and weft yarns while at times shogging weftwise one set of pile yarns over and across warpwise extending pile wires and into the base fabric to form pile extending upwardly from and interwoven with the base fabric while also shogging weftwise the other set of pile yarns over and across groups of ground warp yarns between the pile wires and into the base fabric between the groups of ground warp yarns to form floats extending between the pile and secured to the base fabric, and alternatively and at other times transposing the sets of pile yarns so as to alternatively form pile from the other set of pile yarns and alternatively form floats from said one set of pile yarns.

4. A method of making a pile fabric on a loom and forming warpwise rows of pile loops at a predetermined gauge per given width of the fabric, wherein the loom has means for weaving a base fabric of ground warp and weft yarns and a weftwise row of warpwise extending pile wires is spaced weftwise of and overlies the base fabric, wherein the center-to-center distance between adjacent pile wires is one gauge, wherein two sets of pile yarns extend through respective sets of pile yarn guides arranged in weftwise rows for guiding the respective sets of pile yarns to the fell of the base fabric being woven, and the center-to-center distance between adjacent pile yarn guides in each set is one gauge, said method comprising selectively shogging the sets of pile yarn guides and the respective pile yarn sets weftwise over and across the pile wires for about one-half a gauge and into the base fabric for forming pile loops from the respective pile yarns over the pile wires, and whenever the pile yarn guides of one set and the pile yarns of a respective one of the sets of pile yarns are being shogged over pile wires, shogging the pile yarn guides of the respective other one of the sets, and the respective other pile yarn set, weftwise for a distance of about one half a gauge over and across only those portions of the base fabric located between the pile wires and the warpwise rows of loops so as to form floats of the respective pile yarns over the latter portions of the base fabric and extending between the warpwise rows of pile loops.

5. A method according to claim 4 wherein the extent of each weftwise shog of each pile yarn guide over and across the pile wires is slightly greater than that weftwise distance each set of pile yarn guides is shogged over and across portions of the base fabric located between the pile wires, and the weftwise distance each pile yarn guide is shogged across a pile wire, combined with the weftwise distance each pile yarn guide is shogged across a portion of the base fabric between the pile wires, is equal to one gauge.

6. A method of making a woven pile fabric on a loom having a weftwise row of warpwise extending pile wires, said method comprising forming a base fabric by interweaving ground warp and weft yarns beneath the pile wires so they extend over the base fabric at the fell thereof, while forming pile from two sets of pile yarns by, at times repeatedly shogging each pile yarn of one of said sets back and forth over and across the same respective pile wire, first in one weftwise direction and then in the opposite weftwise direction, and into the base fabric to form pile loops of said one set of pile yarns extending upwardly from and interwoven with the base fabric, while also shogging each pile yarn of the other set back and forth, but in the weftwise direction opposite from that in which said one set of pile yarns is being shogged in each instance, and over and across the same respective warpwise extending portion of the base fabric between the pile wires and into the base fabric to form floats of said other set of pile yarns extending between the pile loops and secured to the base fabric, and at other times repeatedly shogging each pile yarn of said other set back and forth, weftwise of the base fabric, over and across the same respective pile wire and into the base fabric to form pile loops of said other set of pile yarns also extending upwardly from and interwoven with the base fabric, while also shogging each pile yarn of said one set back and forth, but in the weftwise direction opposite from that in which said other set of pile yarns is being shogged in each instance, and over and across the same respective warpwise portion of the base fabric between the pile wires and into the base fabric to form floats of said one set of pile yarns extending between the pile loops of said other set of pile yarns and secured to the base fabric.

7. A method of making a woven pile fabric on a loom having a weftwise row of warpwise extending pile wires, said method comprising forming a base fabric by interweaving ground weft yarns and groups of ground warp yarns beneath the pile wires so they extend over the base fabric at the fell thereof, while forming pile from two sets of pile yarns by, at times repeatedly shogging each pile yarn of one of said sets back and forth over and across the same respective pile wire, first in one weftwise direction and then in the opposite weftwise direction, and into the base fabric to form pile loops of said one set of pile yarns extending upwardly from and interwoven with the base fabric, while also shogging each pile yarn of the other set back and forth, but in the weftwise direction opposite from that in which said one set of pile yarns is being shogged in each instance, and over and across the same respective group of ground warp yarns between the pile wires and into the base fabric between adjacent groups of ground warp yarns to form floats of said other set of pile yarns extending between the pile loops and secured to the base fabric, and at other times repeatedly shogging each pile yarn of said other set back and forth, weftwise of the base fabric, over and across the same respective pile wire and into the base fabric to form pile loops of said other set of pile yarns also extending upwardly from and interwoven with the base fabric, while also shogging each pile yarn of said one set back and forth, but in the weftwise direction opposite from that in which said other set of pile yarns is being shogged in each instance, and over and across the same respective group of warp yarns between the pile wires and into the base fabric between adjacent groups of warp yarns to form floats of said one set of pile yarns extending between the pile loops of said other set of pile yarns and secured to the base fabric.

8. In a loom for weaving pile fabrics having warpwise extending rows of pile tufts formed from two sets of pile yarns with the tufts formed of the two sets being arranged in a predetermined alternating sequence in each row warpwise of the fabric and said loom having means for weaving a base fabric of ground warp and weft yarns, said loom also having a plurality of warpwise extending pile wires spaced weftwise of and overlying the base fabric, and a pair of sets of movable pile yarn guides arranged in weftwise rows for guiding respective sets of pile yarns to the fell of the base fabric being woven, the combination therewith of pattern controlled means for selectively shogging weftwise said sets of pile yarn guides over and across said pile wires and into the base fabric being woven for forming pile loops from the respective pile yarns over and across the pile wires, and said pattern controlled means being operable, whenever the pile yarn guides in either one of said sets are being shogged over pile wires, to alternatively shog weftwise the pile yarn guides of the other set over and across only those portions of the base fabric located between the pile wires so as to form floats of the respective pile yarns over said portions of the base fabric which extend between the pile loops.

9. A loom according to claim 8 in which said pattern controlled means is operable to control the weftwise distance each set of pile yarn guides is shogged so that the distance each pile yarn guide of each set is shogged over and across the pile wires is slightly greater than that distance each pile yarn guide of each set is shogged over and across said portions of the base fabric located between the pile wires, and so that the weftwise distance each pile yarn guide is shogged across a respective pile wire, combined with the weftwise distance each pile yarn guide is shogged across a respective portion of the fabric between the pile wires is about the same as the center-to-center distance between any two adjacent pile wires.

10. A loom according to claim 9 in which the center-to-center distance between any two adjacent pile wires is about 0.200 inch for forming a pile fabric having a pitch of five warpwise rows of pile loops per weftwise inch thereof, and wherein the distance each set of pile yarn guides is shogged across the pile wires is about 0.110 inch, and the distance each set of pile yarn guides is shogged across a respective portion of the fabric between the pile wires is about 0.090 inch.

11. In a loom for weaving pile fabrics having warpwise extending rows of pile tufts formed from two sets of pile yarns with the tufts formed of the two sets being arranged in a predetermined alternating sequence in each row warpwise of the fabric and said loom having means for weaving a base fabric from ground warp and weft yarns, said loom also having a plurality of warpwise extending pile wires spaced weftwise of the loom and overlying the base fabric, and a pair of first and second sets of pile yarn guides arranged in weftwise rows for guiding respective first and second sets of pile yarns to the fell of the base fabric being woven, the combination therewith of pattern controlled means for (a) at times shogging weftwise said first set of pile yarn guides and the first set of pile yarns over and across the pile wires and into the base fabric to form pile extending upwardly from and interwoven with the base fabric, while shogging weftwise said second set of pile yarn guides and the second set of pile yarns over and across portions of the base fabric between the pile wires and into the base fabric to form floats extending weftwise between the pile and secured to the base fabric, and (b) alternatively and at other times shogging weftwise said second set of pile yarn guides and the second set of pile yarns over and across the pile wires and into the base fabric to alternatively form pile from the second set of pile yarns extending upwardly from the base fabric and interwoven therewith, while shogging weftwise said first set of pile yarn guides and the first set of pile yarns over and across those portions of the base fabric located between the pile wires and into the base fabric so as to alternatively form floats of the first set of pile yarns extending weftwise between the pile formed from the second set of pile yarns and also secured to the base fabric.

12. In a loom for weaving pile fabrics and having means for weaving a base fabric of ground warp and weft yarns, said loom also having a weftwise row of warpwise extending pile wires spaced weftwise of and overlying the base fabric, wherein the center-to-center distance between weftwise adjacent pile wires is one gauge, a pair of sets of movable pile yarn guides arranged in weftwise rows for guiding respective sets of pile yarns to the fell of the base fabric being woven, and the center-to-center distance between adjacent pile yarn guides in each set thereof also being one gauge, the combination therewith of pattern controlled means for selectively shogging said sets of pile yarn guides weftwise over and across said pile wires for a distance of about one-half a gauge and into the base fabric for forming pile loops from the respective pile yarns over and across the pile wires, and said pattern controlled means being operable, whenever the pile yarn guides in either one of said sets are being shogged over pile wires, to shog the pile yarn guides of the other set weftwise for a distance of about one-half a gauge over and across only those portions of the base fabric located between the pile wires so as to form floats of the respective pile yarns extending over said portions of the base fabric between the pile loops.

13. A loom according to claim 12 wherein said pattern controlled means is arranged so that the weftwise distance each row of pile yarn guides is shogged across said pile wires is slightly greater than that weftwise distance each row of pile yarn guides is shogged over and across portions of the base fabric located between the pile wires, and wherein the weftwise distance each pile arn guide is shogged across a pile wire, combined with the weftwise distance each pile yarn guide is shogged across a portion of the base fabric between the pile wires, is equal to one gauge.

* * * * *

UNITED STATES PATENT AND TRADEMARK OFFICE

CERTIFICATE OF CORRECTION

PATENT NO. : 4,406,309

DATED : September 27, 1983

INVENTOR(S) : Paul A. Czelusniak, Jr.

It is certified that error appears in the above-identified patent and that said Letters Patent is hereby corrected as shown below:

Claim 2, line 1, after "woven" delete --tufted--; same claim, line 2, after "the" (first occurrence) insert --pile--; same claim, line 3, after "sets" insert --of pile yarns--.

Claim 3, line 1, after "woven" delete --tufted--; same claim, line 2, after "the" (first occurrence) insert --pile--; same claim, line 3, after "sets" insert --of pile yarns--.

Signed and Sealed this

*Thirteenth* Day of *December 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,406,309

DATED : September 27, 1983

INVENTOR(S) : Paul A. Czelusniak, Jr.

It is certified that error appears in the above-identified patent and that said Letters Patent is hereby corrected as shown below:

Column 1, line 19 "pripr" should be --prior--.

Column 1, line 66 "of" should be --or--.

Column 12, line 53 "arn" should be --yarn--.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*